US005195301A

United States Patent [19]

Martin-Cocher et al.

[11] Patent Number: 5,195,301

[45] Date of Patent: Mar. 23, 1993

[54] METHOD AND MACHINE FOR WRAPPING THE VERTICAL LATERAL AND UPPER END FACES OF A PALLETIZED LOAD

[75] Inventors: Jean P. C. Martin-Cocher, La Motte-Servoles; Georges Jaconelli, Aix-les-Bains, both of France

[73] Assignee: Newtec International (Societe Anonyme), Aix-Les-Bains, France

[21] Appl. No.: 909,725

[22] Filed: Jul. 7, 1992

[30] Foreign Application Priority Data

Jul. 11, 1991 [FR] France ..... 91 08766

[51] Int. Cl.[5] ..... B65B 11/04

[52] U.S. Cl. ..... 53/441; 53/465; 53/556; 53/587; 53/588

[58] Field of Search ..... 53/399, 441, 465, 556, 53/210, 587, 588

[56] References Cited

U.S. PATENT DOCUMENTS

| | | | |
|---|---|---|---|
| 4,409,776 | 10/1983 | Vsuz | 53/399 |
| 4,450,668 | 5/1984 | Grossi | 53/556 X |
| 4,905,451 | 3/1990 | Jaconelli | 53/587 X |
| 4,912,911 | 4/1990 | Down | 53/587 X |
| 4,936,080 | 6/1990 | Haloila | 53/465 X |

FOREIGN PATENT DOCUMENTS 0022135 1/1981 European Pat. Off. .

*Primary Examiner*—John Sipos

*Attorney, Agent, or Firm*—Body, Vickers & Daniels

[57] ABSTRACT

A method and apparatus for wrapping the sides and covering the top of a load. The apparatus comprises of a reel of wrapping film and a load support that can be rotated relative to each other about an axis that is coincident with the vertical axis of the load to thereby wrap the sides of the load. The film reel and the load support are further pivotable relative to each other about a second axis that is orthogonal to the load axis as well as slidable relative to each other along this second axis to thereby cover the top face of the load.

26 Claims, 4 Drawing Sheets

METHOD AND MACHINE FOR WRAPPING THE VERTICAL LATERAL AND UPPER END FACES OF A PALLETIZED LOAD

FIELD OF THE INVENTION

The invention relates to a method and a machine for wrapping the vertical lateral and upper end faces of a palletized load.

PRIOR ART

A method is already known for wrapping a load bounded by a lateral face closed on itself and two, upper in which:

an initial outermost portion of a band of film coming from a reel of film is attached to the lateral face of the load;

a relative pivoting movement of the axis of the reel of film and of the load is performed about a first pivoting axis which has a vertical general direction and the band of film is progressively laid over this lateral face;

some film is laid over at least one end face to be covered and in particular the upper face;

the band of film is cut transversely and the terminal outermost portion of the latter is firmly secured to the film already laid or to the load.

A machine enabling this method to be employed is also known, comprising:

means for supporting the load;

means for supporting a reel of a band of film;

first means for achieving a relative pivoting movement of the axis of the reel of film and of the means for supporting the load about a first pivoting axis which has a vertical general direction.

Reference may be made to the following documents: U.S. Pat. Nos. 4,255,918, 4,271,657, 4,336,679, 4,387,548, 4,387,552, 4,418,510, 4,050,221, 4,302,920, FR-A-2,417,167, EP-A-0,110,751, FR-A-2,535,297, FR-A-2,572,359, EP-A-0,180,517, FR-A-2,281,275, EP-A-0,229,736, EP-A-0,032,140, U.S. Pat. No. 4,409,776.

In the case where the palletized load is of parallelepipedal general shape (or of the "palletless" type, as the load is itself organized to form a support), the wrapping is produced in the form of a straight or, more often, spiral strapping and relates to the vertical lateral face of the load. When it is desired also to cover the upper horizontal face of the load it is then necessary to lay, by a separate operation and employing a separate device, a so-called roof sheet. This is therefore complicated.

According to Document EP-A-0,229,736, the cylindrical lateral face and the two circular end faces of a reel of paper of cylindrical general shape are covered by strapping, the reel of film remaining in a stationary general location and the reel of paper being doubly moved, pivotally about a vertical axis and horizontally about its axis of revolution. But this technique is linked with the cylindrical shape of the load and cannot be transposed and applied to a load such as a palletized load. In addition, the end faces receive as many layers of film as axial layers of film on the cylindrical lateral face, which is generally excessive and has drawbacks.

According to Document FR-A-2,505,775, the aim is to improve the force of cohesion applied by the film to the palletized load and, for this purpose, the band of film is applied to tops of the load. There follows a kind of "triangulation" of the load with the band of film. However, this is incapable, in this state, of permitting wrapping of the load with complete covering of its vertical lateral and horizontal upper faces.

According to Document U.S. Pat. No. 4,409,776, a method and machine are described for wrapping a palletized load by spiral strapping, moving up and then moving down, using film having an adhesive face. The film is turned over on itself, between the two strapping operations in order to achieve firm securing, by virtue of a carriage supporting the reel of film, which carriage is mounted so as to pivot by 180° between its two extreme operating positions.

A machine, intended to lay a band of film over two opposed vertical faces and the upper and lower horizontal faces of the palletized load, is also known. But this machine is not suited for the laying of film over the four vertical lateral faces, except with excessive consumption of film, additional thickness over the end faces and doubtful sealing over the vertical lateral faces. In addition, this technique necessarily involves the covering of the lower horizontal face, which may not be desirable or possible.

Finally, the technique of enveloping is known for laying film both over the vertical lateral and upper horizontal faces of a palletized load. However, this technique is generally more complicated to employ than that of strapping.

In the case of machines for wrapping palletized loads by spiral strapping of the film over its vertical lateral faces, variants are also known in which a separate device for laying a roof sheet is attached to the machine. The machine which results from this combination is, however, particularly complicated with inherent drawbacks.

The invention therefore aims to solve the problem of covering an upper end face of a palletized load with a wrapping film when the vertical lateral face of the load is also covered with wrapping film by the technique of strapping.

SUMMARY OF THE INVENTION

For this purpose, the invention provides, according to a first aspect, a method for wrapping a palletized load bounded by a vertical lateral face which is closed on itself and two, upper and lower, end faces, by means of film made from plastic, in which:

an initial outermost portion of a band of film coming from a reel of film is attached to the lateral face of the load;

a relative pivoting movement of the axis of the reel of film and of the load is performed about a first axis which is substantially coincident with the vertical axis of the load and which has a vertical general direction and, as a result of this movement, the band of film is progressively laid over this lateral face;

film is laid over the upper end face to be covered;

the band of film is cut transversely and the terminal outermost portion of the band is firmly secured to the laid film or to the load, film coming from the reel of film is laid over the upper end face to be covered and, for this purpose, when the band of film is in the vicinity of the upper end face, at least one pass is carried out in which:

the relative pivoting movement about the first axis is stopped;

a relative pivoting movement of the order of one quarter or of three quarters of a turn of the axis of the reel of film and of the load is performed about a second axis which has a horizontal general direction and the reel of film is thus brought from a substantially vertical position which is parallel to and close to the lateral face of the load to a general position close to and parallel to the upper end face to be covered, the axis of the reel of film then being substantially orthogonal to the second axis;

in this situation, at least one relative sliding movement of the axis of the reel of film and of the load is performed substantially along the second axis over a travel of the order of the longitudinal dimension of the upper end face of the load measured along the second axis until it is covered with the film;

a relative pivoting movement of the order of one quarter or three quarters of a turn of the axis of the reel of film and of the load is then performed about the second axis until the reel of film is brought into a position substantially parallel to and close to the lateral face of the load;

the relative pivoting movement about the first axis is started again.

According to a second aspect, the invention provides a machine for wrapping a load, employing a band of film whose width is at least equal to or of the order of the transverse dimension of the upper end face to be covered.

The invention offers numerous advantages: the same film may be used both for the covering of the lateral face and of the upper end face without discontinuity. The force of cohesion of the load, its protection and its sealing are improved. The technical properties of the film may be employed both for the lateral face and the end face. The covering of the lateral face and of the end face is obtained without annoying additional thicknesses, without excessive multiplication of superposed layers of film. The machine in accordance with the invention essentially includes the means employed for the strapping with, in addition, only the relative second pivoting and the relative sliding employed for the covering of the upper end face. Such a machine has a high rate of operation, the machine being, in addition, simultaneously simple and reliable. It is also possible to envisage different variants of implementation of the invention using stretchable film or shrinkable film; with complete or only partial covering; with single or double spiral or straight strapping. In the case of a stretchable film, it is possible to have different stretching rates for the various portions of the load, which enables its cohesion to be improved. The invention is more especially applicable to a palletized load, the vertical lateral face and the upper end face of which are covered.

According to other characteristics of the method according to the invention, a band of film is employed whose width is at least equal to or of the order of the transverse dimension of the upper end face to be covered so as to permit a total covering of this face by means of a single layer of film if necessary. The relative pivoting movement about the second axis, of the order of one quarter to three quarters of a turn, is performed in order to pass the reel of film from a generally vertically situation to a generally horizontal situation (or conversely). The relative pivoting movement about the first pivoting axis for the covering of the upper end face to be covered is stopped. During the laying of the band of film over the lateral face, a relative sliding movement of the axis of the reel of film and of the load is performed in a general direction parallel to the first axis, which permits a spiral strapping. The relative pivoting movement about the second axis is performed when the reel of film has been brought into a general position some distance away from the lateral face and from the end face to be covered and when the band of film leaves the lateral face in the vicinity of the upper end face to be covered. According to one variant, once the relative pivoting movement about the second axis has started, the relative sliding movement of the axis of the reel of film and of the load in the general direction parallel to the first axis is stopped, that is to say the reel of film then remains essentially in the same horizontal plane. Several passes may be carried out in order to cover the upper end face to be covered with several superposed, parallel and/or crossed layers. A band of film is employed whose width is a fraction of the distance separating the two end faces of the load. At least one spiral strapping of the lateral face is produced. This strapping has contiguous or overlapping turns. The covering of the end face is preferably produced between two spiral strapping operations in opposite directions. In a first embodiment stretchable film is employed and in a second embodiment heat-shrinkable film is employed. In the case of stretchable film, the band of film is stretched between the load and the reel of film or by prestretching before its application onto the load. The band of film is also stretched during the covering of the upper end face to be covered.

A palletized load is employed which has a lateral face extending in a vertical general direction and upper and lower end faces extending in a horizontal general direction. The first axis is then of vertical general direction and, during the strapping, substantially coincident with that of the load. The second axis has a horizontal general direction. In a first variant, for the strapping, the load is driven pivotally about its vertical axis, the axis of the reel of film being arranged in order to be moved pivotally about a horizontal axis substantially orthogonal to the median vertical plane of the machine and slidingly along a vertical general direction. According to a second variant, the load is stationary for the strapping, the axis of the reel of film being driven pivotally about the vertical axis of the load, pivotally about the same horizontal axis and slidingly along the vertical general direction.

According to another aspect and a first embodiment, the relative sliding movement along the second axis is carried out by a sliding of the load alone and, in a second embodiment, by sliding of the axis of the reel of film alone. Optionally, there is combined sliding of the load and of the axis of the reel. The variants and the embodiments may be combined.

According to other characteristics of the machine, the latter furthermore comprises fourth means for achieving a relative sliding movement of the axis of the reel of film and means for supporting the load in a general direction parallel to the first axis, the actuation means acting on the fourth sliding means in order to coordinate their operation with that of the first, second and third relative sliding and pivoting means. The machines may furthermore also comprise means for gripping an initial outermost portion of a band of film; means for firmly securing a terminal outermost portion of a band of film to the film already laid or to the load; and means for transversely cutting the band of film. The second relative pivoting means achieve a relative locking in at least two operating positions which are angularly some distance away from each other by approximately one quarter or three quarters of a turn. As a result the machine can operate with the reel of film vertical or horizontal, depending on the operating phases. In the case of a machine employing stretchable film, the machine may include means for stretching or prestretching the band of film. The means for supporting the load comprise a table of horizontal general direction, therefore of vertical axis; the means for supporting a reel of film comprise at least one post of vertical general direction and a reel-of-film support carriage carried directly or indirectly by the post and mounted so as to slide vertically and so as to pivot about a horizontal axis orthogonal to the axis of the reel of film and orthogonal to the median vertical plane of the machine connecting the axis of the table to that of the post. According to a first variant corresponding to the first method variant already described, the table is mounted so as to pivot about an axis of vertical general direction and the post is stationary. According to a second variant, the table is stationary and the carriage is arranged so as to describe a double movement, of vertical sliding and of rotation along a ring surrounding the table. The machine may also comprise two embodiments corresponding to those already mentioned for the method. The first, in which the table or load-supporting elements attached to the table are mounted so as to slide along the second axis. The second, where the sliding relates to the means for supporting the reel of film or to reel-supporting elements attached to these means. The variants and the embodiments may be combined.

BRIEF DESCRIPTION OF THE DRAWINGS

The other characteristics of the invention will be better understood by virtue of the description which follows of one possible embodiment in the case of a palletized load, the vertical lateral faces and the upper horizontal face of which are covered by spiral strapping, the load being movably mounted so as to pivot about its vertical axis, and the attached drawings in which.

DESCRIPTION OF THE PREFERRED EMBODIMENTS

Figure 1A:
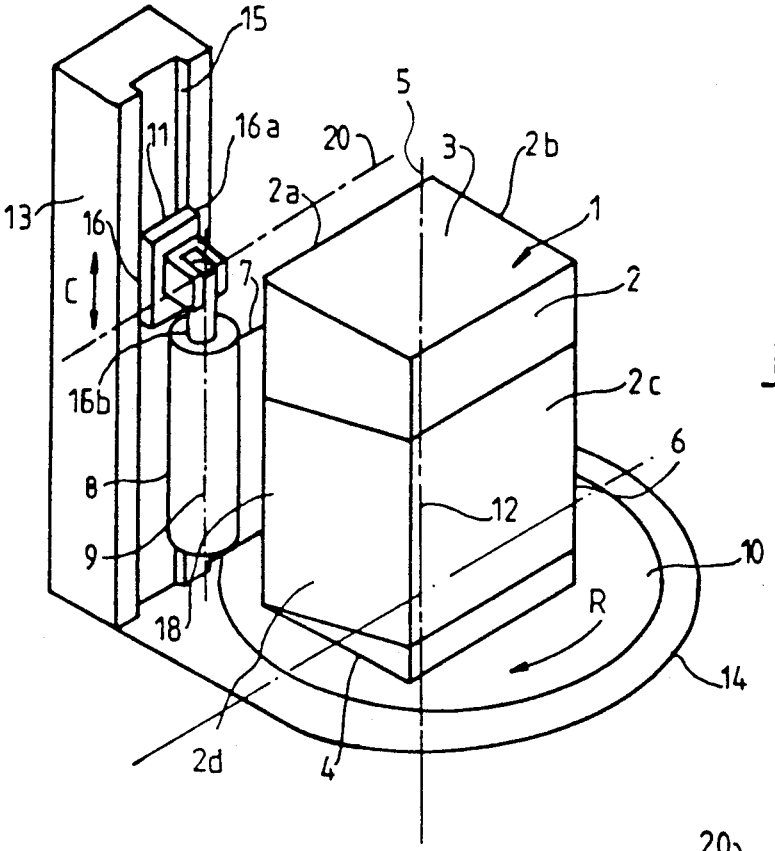
FIGS. 1A, 1B, 1C, 1D, 1E are 1F are six perspective diagrammatic views illustrating the successive stages of the method according to the invention as well as the machine according to the invention.

Reference will now be made more especially to FIGS. 1A to 1F in which is shown a palletized load 1 bounded by a lateral face 2 which is closed on itself and by two, respectively, upper 3 and lower 4, horizontal end faces. Such a load has a vertical general axis 5. The lateral face 2 includes four panels *2a*, *2b*, *2c*, *2d* located in paired vertical planes perpendicular to each other, defining four vertical edges 6 parallel to the axis 5.

The palletized load 1 is wrapped by means of a film 7 made from plastic coming from a reel 8 of film of axis 9.

In the embodiment illustrated by the figures, the film 7 covers the lateral face 2 and the upper horizontal face 3.

The method employs a wrapping machine which comprises means 10 for supporting the load 1; means 11 for supporting the reel 8 of film and first means (not shown) such as a motor or gear motor for achieving a relative pivoting movement of the axis 9 of the reel of film and of the means 10 for supporting the load about a first axis which has a vertical general direction and which is more precisely coincident with the axis 5.

In the embodiment in question, the support means 10 comprise a table 12 of vertical axis thus coincident with the axis 5. The means 11 comprise or are attached to a vertical post 13 placed to the side of the table 10 on a support 14 forming a baseplate. A carriage 16 supporting the reel 8 is mounted on the post 13 so as to slide vertically by virtue of sliding members 15.

The invention is also applicable to other types of machines, especially those having a rotationally fixed table and a reel of film of axis rotating about the axis of the table, the carriage 16 then being arranged so as to describe a double movement, of vertical sliding and of rotation along a ring surrounding the table 10.

In the embodiment envisaged, the film 7 has a width which is a fraction of the distance between the two end faces 3 and 4 whilst being at least equal to or of the order of the transverse dimension of the end face 3 to be covered. By transverse dimension is meant here the dimension of the face 3 measured orthogonally to a second axis mentioned hereinbelow.

In this embodiment, the film employed is more especially a stretchable film which is stretched, before being applied onto the load, by virtue of a prestretching device (not shown) carried by the carriage 16. This prestretching device may include one or more rollers over which the film 7 passes so that the film is drawn off downstream at a greater speed than the upstream speed.

In the step illustrated by FIG. 1A, an initial outermost portion 18 of the band of film 7 is attached to the lateral face 2 of the load, for example by means of a holding gripper (not shown) carried by or in the vicinity of the table 10. This attachment takes place in the vicinity of the lower horizontal face 4. In this situation and in the embodiment envisaged, the axis 9 of the reel 8 of film is then placed vertically.

Next the table 10, and therefore the palletized load 1, are driven pivotally about the axes 5, 12 in the direction of the arrows R which permits the strapping, the axis 9 of the reel 8 of film remaining vertical, the film 7 being applied flat and over its entire breadth over the lateral face 2. When this involves a spiral strapping of the lateral face 2 with the film 7 with overlapping turns, the reel 8 of film is slid along its axis 9 upwards and towards the upper horizontal face 3 (arrow C). In this situation, the reel 8 of film is therefore moved parallel to the first axis 12. This vertical upward sliding of the reel 8 of film is continued until the reel 8 of film is at least partially above the horizontal plane of the upper face 3. In this situation, the reel 8 of film is therefore a short distance away from the lateral face 2 and from the upper face 3 to be covered. In addition, the film 7 then leaves the lateral face 2 in the vicinity of the upper face 3 to be covered.

The relative pivoting movement of the axis 9 of the reel 8 of film and of the load 1 (in the present case the pivoting of the load) about the first axis 12 enables the strip of film 7 to be progressively laid over the lateral face 2.

The same film 7 as that coming from the reel 8 an intended for the wrapping of the lateral face 2 is laid over the end face 3.

Figure 1B:
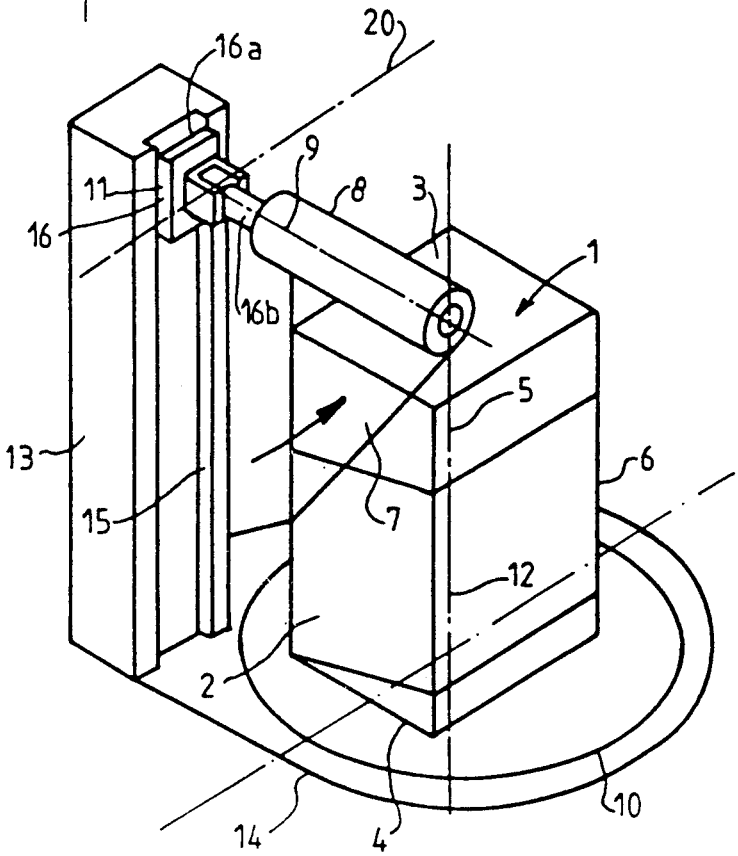
Figure 1C:
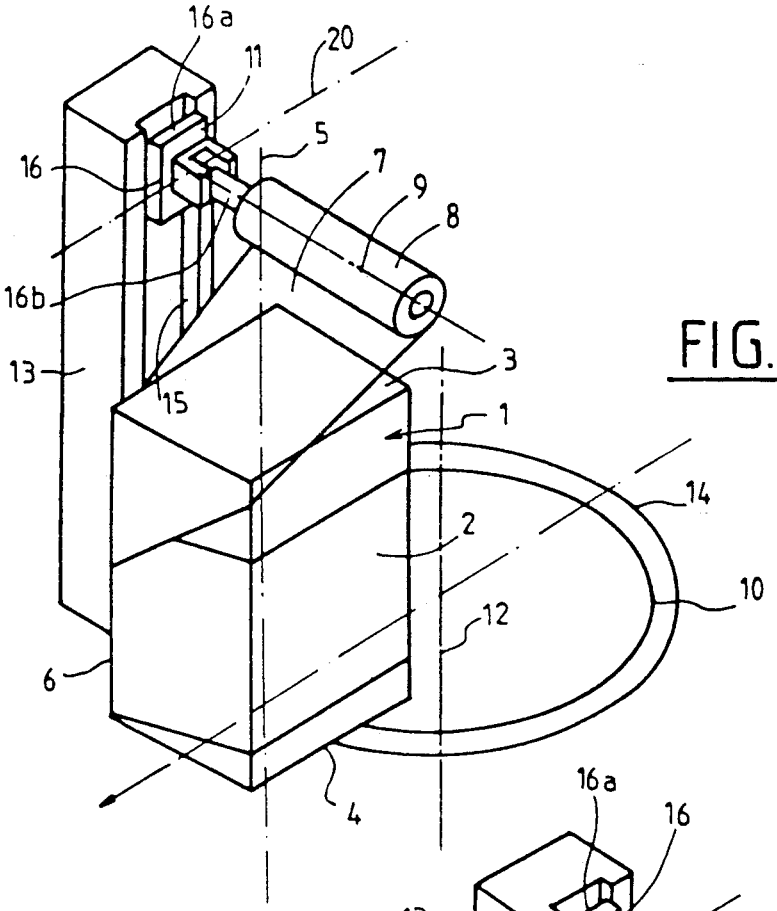
Figure 1D:
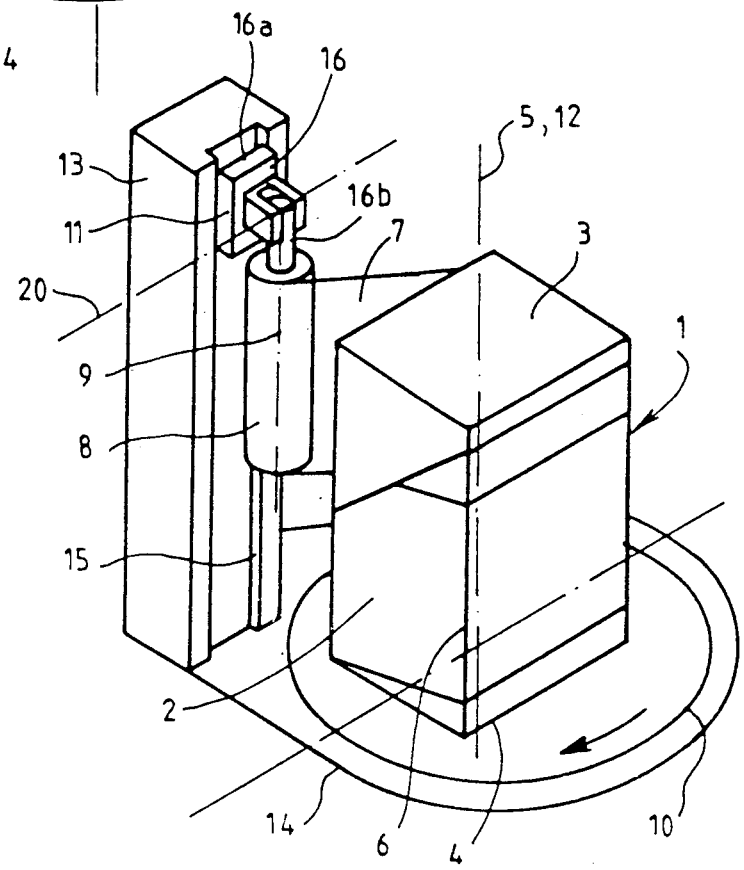

For this purpose, when the band-of film 7 is in the vicinity of the upper face 3, at least one pass is carried out in which first of all the relative pivoting movement about the first axis 5, 12 is stopped. A relative pivoting movement, of the order of one quarter or of three quarters of a turn, of the axis 9 of the reel 8 of film and of the load is performed about a second axis 20 which has a horizontal general direction. Thus the reel 8 of film is brought from its front position, where it is substantially vertical and parallel to and close to the lateral face 2, as far as a general position close to and parallel to the upper end face 3 to be covered. The axis 9 is then placed horizontally and substantially orthogonal to the second axis 20 (FIG. 1B). In this situation, at least one relative sliding movement of the axis 9 of the reel of film and of the load 1 is performed substantially along the second axis 20. This sliding movement is carried out over a travel of the order of (or slightly less than) the longitudinal dimension of the end face 3. This longitudinal dimension is measured along the second axis 20. The consequence of this sliding movement is the progressive covering of the upper end face 3 to be covered with the film 7 from one side of the lateral face to the opposite side (FIG. 1C).

Next (FIG. 1D), a relative pivoting movement, of the order of one quarter or of three quarters of a turn, of the axis 9 of the reel of film and of the load 1 is performed about the second axis 20. This has the effect of bringing the reel of film back into a substantially vertical position, parallel to and close to the lateral face 2 of the load 1. The relative pivoting movement about the first axis 12 may then start again.

The second axis 20 is substantially perpendicular to that median vertical plane of the machine joining the axis 12 and the vertical principal axis of the post 13, which enables any annoying mutual interference of the portions of the machine (or of the load) to be avoided.

The result of the preceding steps is that the film 7 has been applied over the upper horizontal end face 3 to be covered.

Figure 1E:
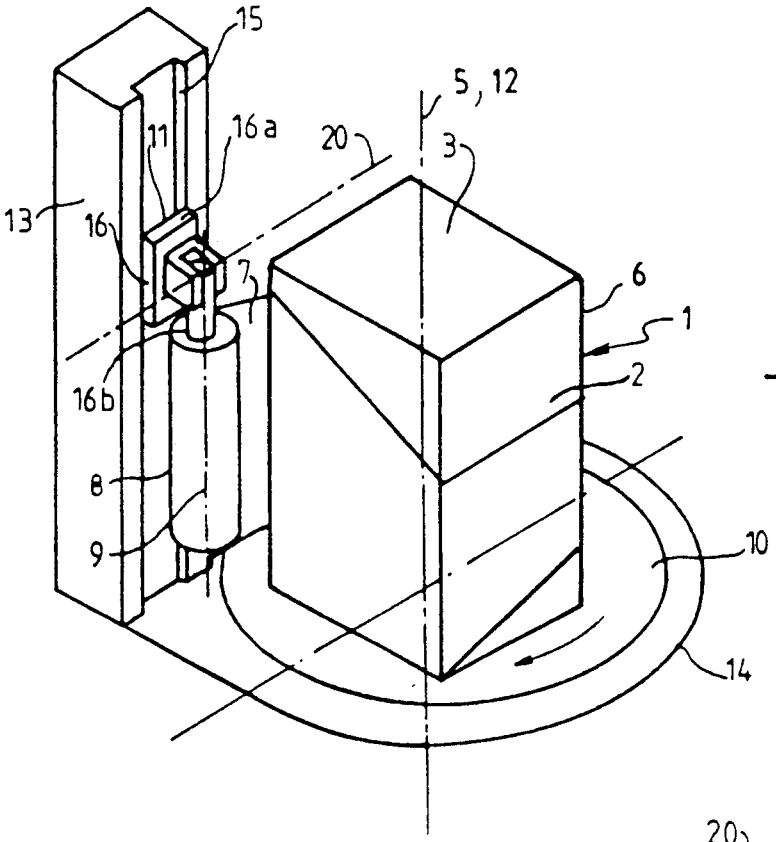
Figure 1F:
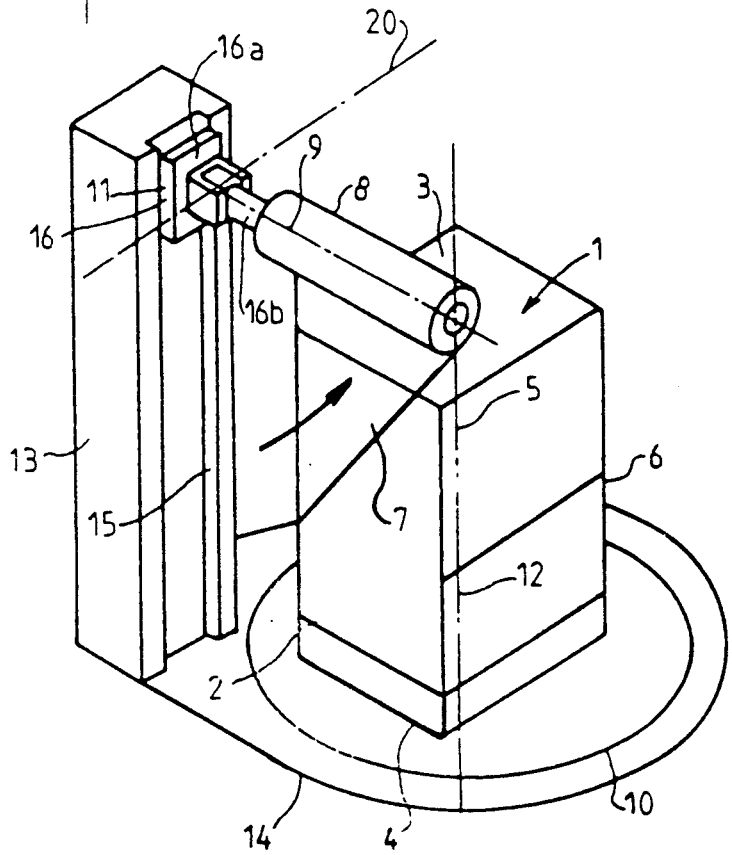

In FIGS. 1E and 1F are illustrated a second pass enabling the end face 3 to be covered with the band of film 7, the band being disposed as several superposed layers. These layers are parallel and/or crossed, depending on the procedure employed.

A second downward spiral strapping is then produced so as to cross the upward spiral strapping previously produced over the lateral face 2.

When the band of film 7 comes to the vicinity of the lower horizontal end face 4 until being brought into a position similar to that shown in FIG. 1A. In this situation, the previously mentioned gripper (opened beforehand) catches the film 7 again. The band of film 7 may then be cut transversely. Its terminal outermost portion may be firmly secured to the previously laid film or to the load 1 itself.

Although the description has been made in the case of a load 1 mounted so as to pivot about the axis 5, the method is also applicable in the case where the load is stationary, the axis 9 of the reel 8 of film rotating about the axis 5 and the reel 8 of film itself rotating about the load 1.

Figure 2A:
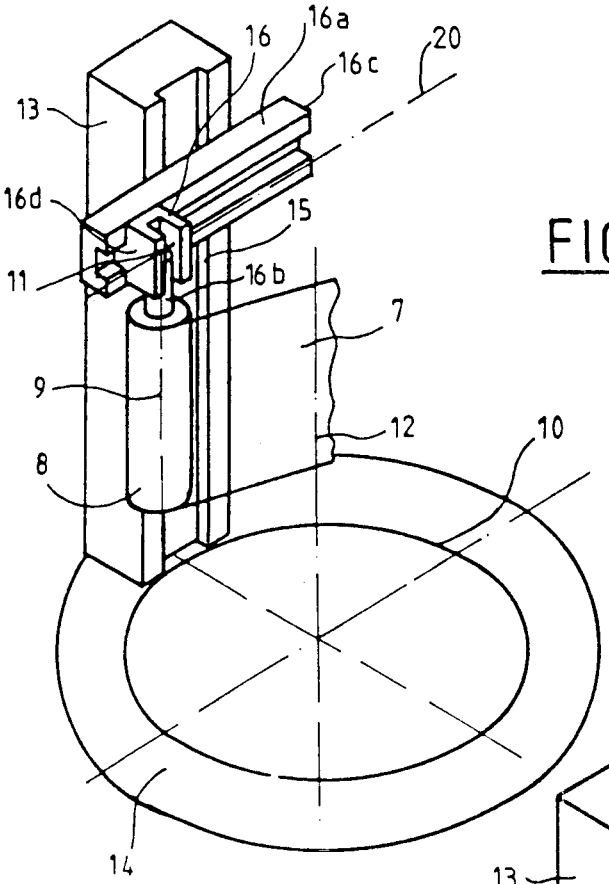
FIGS. 2A and 2B are two partial perspective diagrammatic views illustrating two stages of the method according to another machine variant.
Figure 2B:
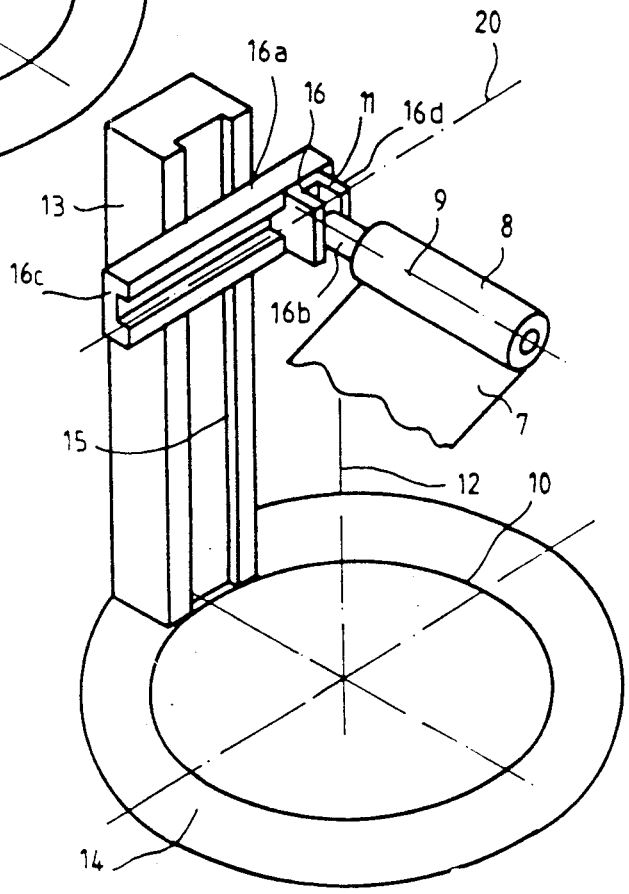

Two principal alternative embodiments may be envisaged as regards the relative sliding movement along the second axis 20. The load 1 is either moved slidingly along the second axis 20 while, simultaneously, the axis 9 of the reel of film remains stationary (FIG. 1A to 1F). Or, by contrast, the load 1 remains stationary while, simultaneously, the axis 9 is moved slidably along the second axis 20 (FIGS. 2A and 2B).

The machine also comprises second means for achieving a relative pivoting movement of the axis 9 of the reel 8 of film and of the means 10 for supporting the load about the second pivoting axis 20. These second means are arranged in order to permit the reel of film to be either in a vertical position or in a horizontal position.

The machine also comprises third means for achieving a relative sliding movement of the axis 9 of the reel 8 of film and of the means 10 for supporting the load 1 substantially along the second axis 20 over a certain travel.

The machine also comprises actuation means acting on the first, second and third means for achieving the two relative pivoting movements and the relative sliding movement in order to coordinate their operation so as to permit the previously described steps of the method.

The machine also comprises fourth means for achieving a relative sliding movement of the axis 9 of the reel 8 of film and of the means 10 for supporting the load in a general direction parallel to the first axis 12. These fourth means comprise the sliding member 15. The actuation means thus also act on these fourth sliding means in order to coordinate their operation with that of the first, second and third relative sliding and pivoting means.

The machine furthermore comprises means for gripping an initial free outermost portion 18 of the band of film 7, such as a gripper located in the vicinity of the support table 10; means for firmly securing a terminal outermost portion of this band of film to the film already laid over the load or to the load itself as well as means for transversely cutting the band of film. These various means may be carried by the same gripper.

The second means achieve the relative locking of the axis 9 in at least two operating positions which are angularly separated from each other by approximately one quarter or three quarters of a turn.

When the machine employs stretchable film, it includes means for stretching or prestretching the band of film, which means may also be active during the covering of the upper face 3.

The second relative pivoting means may include a carriage in two portions, namely a portion **16*a* directly attached to the post 3 and arranged in order to be able to slide on the latter and a portion 16*b*, mounted on the portion 16*a* constituting or supporting the spindle of the reel 8 of film and, if necessary, the stretching or prestretching means. These two portions 16*a*, 16*b* are connected together by means of a pivoting pin coaxial with the axis 20. Driving members such as a motor, gear motor, gear train, cog belts or the equivalents which are more especially carried by the portion 16*a* enable the relative pivoting of the portion 16*b* in relation to the portion 16*a* about the axis 20** to be achieved.

In the embodiment of FIGS. 1A to 1F, the third means for relative sliding along the second axis 20 act on and are attached to the support table 10 or, possibly, to load-support elements attached to the table 10. For example, the table 10 is a table having lockable rollers. Attached to it is a coplanar conveyor also with lockable rollers. Driving means achieve the driving, or alternatively the locking, of the table and of the conveyor as well as the pivoting, or alternatively the locking, in terms of rotation, of the table 10. In particular, a position is provided in which the conveyor extends the table, the rollers all being of parallel axes. In this situation the positive driving of the rollers, of the table and of the conveyor enables the load 1, to which the film 7 is attached, to pass from the table 10 to the conveyor, which corresponds to the sliding travel in question, the table and the conveyor extending in a parallel manner along the axis 20. In this embodiment, the reel 8 of film is mounted so as to slide vertically on the post 13 and pivotally about the axis 20 but not slidingly along the axis 20. According to another possible embodiment, the table 10 is stopped with its rollers extending in a parallel manner (not orthogonally) to the axis 20 and a raising and horizontally sliding means is provided beneath the table 10, which means can pass between the rollers between a retracted lower position and an upper position in vertical line with the table 10 (near position) and an upper position some distance away from the table 10 (far position).

In the embodiment of FIGS. 2A and 2B, the third sliding means are attached to the carriage 16. For this purpose, the portion 16*a* is itself in two portions, namely a portion 16*c* mounted directly on the post 13 so as to slide vertically and having a slide force extending along the axis 20 and a portion 16*d* mounted so as to slide on the slideway 16*c*, by virtue of suitable driving means (even endless means, gear motor, pulleys, driving chain). The portion 16*b* is mounted on the portion 16*d*. In this variant, the table 10 is conventional, that is to say it is not especially arranged for sliding of the load 1 during the strapping process.

We claim:

1. A method for wrapping a palletized load bounded by a vertical lateral face which is closed on itself and two, upper and lower, end faces, by means of film made from plastic, in which:

attaching an initial outermost portion of a band of film coming from a reel of film to the lateral face of the load;

relatively rotating the axis of the reel of film and of the load about a first axis which is substantially coincident with the vertical axis of the load and which has a vertical general direction and, as a result of this movement, the band of film is progressively laid over this lateral face;

depositing said film over the upper end face to be covered;

cutting the band of film transversely and securing the terminal outermost portion of the band to the load, wherein said step of depositing said film over the upper face comprises:

stopping the relative rotation about the first axis;

relatively pivoting the axis of the reel of the film and of the load of the order of one quarter of a turn about a second axis which has a horizontal general direction and bringing the reel of film from a substantially vertical position which is parallel to and close to the lateral face of the load to a general position close to and parallel to the upper end face to be covered, the axis of the reel of film then being substantially orthogonal to the second axis;

in this situation, making at least one relative sliding movement of the axis of the reel of film and of the load substantially along the second axis over a travel of the order of the longitudinal dimension of the upper end face of the load measured along the second axis until it is covered with the film;

relatively pivoting the axis of the reel of the film and of the load of the order of one quarter of a turn about the second axis until the reel of film is brought into a position substantially parallel to and close to the lateral face of the load;

starting the relative rotation about the first axis.

2. The method as claimed in claim 1, wherein a band of film is employed whose width is at least equal to or of the order of the transverse dimension of the upper end face to be covered.

3. The method as claimed in claim 1, wherein during the laying of the band of film over the lateral face, a relative sliding movement of the axis of the reel of film and of the load is performed in a general direction parallel to the first axis.

4. The method as claimed in claim 1, wherein the relative pivoting movement about the second axis is performed when the reel of film has been brought into a general position some distance away from the lateral face and from the upper end face to be covered and wherein the band of film leaves the lateral face at the location or in the vicinity of the upper end face to be covered.

5. The method as claimed in claim 1, wherein several passes are carried out in order to cover the upper end face to be covered so that the band of film is laid as several superposed, parallel and/or crossed layers.

6. The method as claimed in claim 1, wherein a band of film is employed whose width is a fraction of the distance separating the two, upper and lower, end faces of the load.

7. The method as claimed in claim 6, wherein at least one spiral strapping of the lateral face is produced.

8. The method as claimed in claim 7, wherein a spiral strapping has contiguous or overlapping turns.

9. The method as claimed in claim 7, wherein the covering of the end face is produced between two spiral strapping operations in opposite directions of the lateral face of the load.

10. The method as claimed in claim 1, wherein a band of stretchable film is employed.

11. The method as claimed in claim 1, wherein a band of heat-shrinkable film is employed.

12. The method as claimed in claim 10, wherein the band of film is stretched between the load and the reel of film or by prestretching before its application onto the load.

13. The method as claimed in claim 1, wherein the band of film is also stretched during the covering of an end face to be covered.

14. The method as claimed in claim 1, wherein the load is rotated about its vertical axis coincident with the first axis, the axis of the reel of film being moved pivotally about a second axis some distance away from the load.

15. The method as claimed in claim 1, wherein the load is stationary, the axis of the reel of film is rotated about the vertical axis of the load, which axis is coincident with the first axis, and moved pivotally about a second axis some distance away from the load.

16. The method as claimed in claim 1, wherein the relative sliding movement of the axis of the reel of film and of the load along the second axis is achieved by sliding movement of the load.

17. The method as claimed in claim 1, wherein the relative sliding movement of the axis of the reel of film and of the load along the second axis is achieved by sliding movement of the axis of the reel of film.

18. A machine for wrapping a load by means of a film made from plastic, comprising:

means for supporting the load having an axis;

means for supporting a reel of a band of film having an axis parallel to said axis of the load;

first means for achieving a relative rotation of the axis of the reel of film and of the means for supporting the load about a first axis which has a general direction parallel to the axis of the reel of film for wrapping the sides of the load parallel to its axis, which also comprises:

second means for achieving a relative pivoting movement of the axis of the reel of film and of the means for supporting the load about a second axis which has a general direction orthogonal to the first pivoting axis and to the axis of the reel of the film between at least two operating positions, some distance away from the axis, of one quarter of a turn and for achieving a relative locking in these two positions;

third means for achieving a relative sliding movement of the axis of the reel of film and of the means for supporting the load substantially along the second axis, over a certain travel for covering an end of the load perpendicular to its axis;

and actuation means acting on the first, second and third means for achieving the two relative pivoting movements and the relative sliding movement so as to coordinate their operation.

19. The machine as claimed in claim 18, which furthermore comprises fourth means for achieving a relative sliding movement of the axis of the reel of film and of the means for supporting the load in a general direction parallel to the first axis; the actuation means also acting on the fourth sliding means in order to coordinate their operation with that of the first, second and third relative sliding and pivoting means.

20. The machine as claimed in either of claims 18 and 19, which furthermore comprises means for gripping an initial outermost portion of the band of film; means for firmly securing a terminal outermost portion of the band of film to the laid film or the load; and means for transversely cutting the band of film.

21. The machine as claimed in claim 18, wherein which includes means for stretching or for prestretching the band of film.

22. The machine as claimed in claim 18, wherein the means for supporting the load comprise a table of horizontal general direction; the means for supporting a reel of film comprise at least one post of vertical general direction and a reel-of-film support carriage carried directly or indirectly by the post and mounted so as to slide vertically and to pivot about the second axis.

23. The machine as claimed in claim 18, wherein the table is mounted so as to rotate about an axis of vertical general direction and the post is stationary.

24. The machine as claimed in claim 18, wherein the table is stationary and the carriage is arranged so as to describe a double movement, of vertical sliding and of rotation, along a ring surrounding the table.

25. The machine as claimed in claim 24, wherein the load-support table or load-support elements attached to the table are mounted so as to slide along the second axis over a certain travel between a near position, where the table can pivot about a first axis, and a far position.

26. The machine as claimed in claim 18, wherein the means for supporting the reel of the film or reel-supporting elements attached to these means are mounted so as to slide along the second axis over a certain travel between a near position and a far position.

* * * * *